US010954576B2

(12) United States Patent
Ota et al.

(10) Patent No.: US 10,954,576 B2
(45) Date of Patent: Mar. 23, 2021

(54) HIGH-STRENGTH STEEL, METHOD FOR MANUFACTURING HIGH-STRENGTH STEEL, STEEL PIPE, AND METHOD FOR MANUFACTURING STEEL PIPE

(71) Applicant: JFE STEEL CORPORATION, Tokyo (JP)

(72) Inventors: Shusaku Ota, Tokyo (JP); Junji Shimamura, Fukuyama (JP); Nobuyuki Ishikawa, Kawasaki (JP); Shigeru Endo, Chiba (JP)

(73) Assignee: JFE STEEL CORPORATION, Tokyo (JP)

( * ) Notice: Subject to any disclaimer, the term of this patent is extended or adjusted under 35 U.S.C. 154(b) by 223 days.

(21) Appl. No.: 15/560,013

(22) PCT Filed: Mar. 27, 2015

(86) PCT No.: PCT/JP2015/001768

§ 371 (c)(1),
(2) Date: Sep. 20, 2017

(87) PCT Pub. No.: WO2016/157235

PCT Pub. Date: Oct. 6, 2016

(65) Prior Publication Data

US 2018/0066332 A1 Mar. 8, 2018

(51) Int. Cl.

| | |
|---|---|
| ***C21D 9/08*** | (2006.01) |
| ***C22C 38/14*** | (2006.01) |
| ***C22C 38/58*** | (2006.01) |
| ***C21D 8/10*** | (2006.01) |
| ***C22C 38/00*** | (2006.01) |
| ***C21D 8/02*** | (2006.01) |
| ***C21D 9/46*** | (2006.01) |
| ***C22C 38/22*** | (2006.01) |
| ***C21D 6/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/16*** | (2006.01) |
| ***C22C 38/26*** | (2006.01) |
| ***C22C 38/28*** | (2006.01) |
| ***C22C 38/38*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

(52) U.S. Cl.

CPC ..... *C21D 9/08* (2013.01); *C21D 6/004* (2013.01); *C21D 6/005* (2013.01); *C21D 6/008* (2013.01); *C21D 8/02* (2013.01); *C21D 8/10* (2013.01); *C21D 8/105* (2013.01); *C21D 9/46* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/22* (2013.01); *C22C 38/26* (2013.01); *C22C 38/28* (2013.01); *C22C 38/38* (2013.01); *C22C 38/42* (2013.01); *C22C 38/44* (2013.01); *C22C 38/46* (2013.01); *C22C 38/48* (2013.01); *C22C 38/50* (2013.01); *C22C 38/58* (2013.01); *C21D 2211/002* (2013.01)

(58) Field of Classification Search
None
See application file for complete search history.

(56) References Cited

U.S. PATENT DOCUMENTS

| | | | |
|---|---|---|---|
| 8,778,096 | B2 | 7/2014 | Shimamura et al. |
| 2009/0252641 | A1 | 10/2009 | Hoshi et al. |
| 2011/0168304 | A1 | 7/2011 | Ishikawa et al. |
| 2011/0253267 | A1 | 10/2011 | Ishikawa et al. |
| 2012/0305122 | A1 | 12/2012 | Ishikawa et al. |
| 2013/0000798 | A1 | 1/2013 | Sadasue et al. |
| 2013/0004787 | A1 | 1/2013 | Ishiyama et al. |
| 2015/0059912 | A1 | 3/2015 | Shimamura et al. |
| 2015/0075682 | A1 | 3/2015 | Yuga et al. |
| 2015/0090370 | A1* | 4/2015 | Shimamura ..... C22C 38/40 148/521 |

(Continued)

FOREIGN PATENT DOCUMENTS

| | | | |
|---|---|---|---|
| CA | 2867798 | A1 | 10/2013 |
| CA | 2868593 | A1 | 10/2013 |
| CN | 102639734 | A | 8/2012 |
| EP | 2505681 | A1 | 10/2012 |

(Continued)

OTHER PUBLICATIONS

Chinese Office Action for Chinese Application No. 201580078182.7, dated May 8, 2019, with Concise Statement of Relevance of Office Action, 5 pages.

(Continued)

*Primary Examiner* — Anthony J Zimmer
*Assistant Examiner* — Michael J Kachmarik
(74) *Attorney, Agent, or Firm* — RatnerPrestia

(57) ABSTRACT

A high-strength steel having a specified chemical composition, wherein parameter $P_{eff}$ is 0.050% or more, the relationship $(TS_0-TS)/TS_0 \leq 0.050$ is satisfied, wherein TS is defined as tensile strength determined at a temperature of 350° C. after aging has been performed under the condition of a Larson-Miller Parameter (LMP) of 15700, and wherein $TS_0$ is defined as tensile strength determined at a temperature of 350° C. before the aging is performed, and having a toughness represented by a $vE_{-20}$ of 100 J or more in a weld heat-affected zone, which is formed when welding is performed.

16 Claims, No Drawings

(56) References Cited

FOREIGN PATENT DOCUMENTS

| | | | | |
|---|---|---|---|---|
| EP | 2505683 | A1 | 10/2012 | |
| EP | 2832890 | A1 | 2/2015 | |
| EP | 2871253 | A1 | 5/2015 | |
| JP | 2000290728 | A | 10/2000 | |
| JP | 2005023423 | A | 1/2005 | |
| JP | 2006233301 | A | 9/2006 | |
| JP | 2006316298 | A | 11/2006 | |
| JP | 2007119884 | A | 5/2007 | |
| JP | 2007224408 | A | 9/2007 | |
| JP | 2008195991 | A | 8/2008 | |
| JP | 2011094231 | A | 5/2011 | |
| JP | 2011132601 | A | 7/2011 | |
| JP | 4821939 | A | 11/2011 | |
| JP | 2012017522 | A | 1/2012 | |
| JP | 2012126925 | A | 7/2012 | |
| JP | 5055736 | A | 10/2012 | |
| JP | 2013112872 | A | 6/2013 | |
| JP | 2013227671 | A | 11/2013 | |
| JP | 2013227671 | A * | 11/2013 | ..... B23K 9/025 |
| JP | 2014034708 | A | 2/2014 | |
| JP | 2014040648 | A | 3/2014 | |
| JP | 2014077642 | A | 5/2014 | |
| JP | 2014088623 | A | 5/2014 | |
| JP | 5605526 | B2 | 10/2014 | |
| WO | 2012108027 | A1 | 7/2014 | |

OTHER PUBLICATIONS

Canadian Office Action for Canadian Application No. 2,980,983, dated Oct. 17, 2018, 5 pages.

Korean Office Action for Korean Application No. 10-2017-7025931, dated Oct. 17, 2018, with Concise Statement of Relevance of Office Action, 6 pages.

Chinese Office Action for Chinese Application No, 201580078182.7, dated Jul. 18, 2018, with Concise Statement of Search Report, 6 pages.

International Search Report and Written Opinion for International Application PCT/JP2015/001768, dated Jun. 23, 2015—5 Pages.

Extended European Search Report for European Application No. 15 887 393.5, dated Feb. 15, 2018, 13 pages.

* cited by examiner

HIGH-STRENGTH STEEL, METHOD FOR MANUFACTURING HIGH-STRENGTH STEEL, STEEL PIPE, AND METHOD FOR MANUFACTURING STEEL PIPE

CROSS REFERENCE TO RELATED APPLICATIONS

This is the U.S. National Phase application of PCT/JP2015/001768, filed Mar. 27, 2015, the disclosure of this application being incorporated herein by reference in its entirety for all purposes.

TECHNICAL FIELD OF THE INVENTION

The present invention relates to high-strength steel having a tensile strength of 620 MPa or more after having been subjected to long-term aging in a mid-temperature range, a method for manufacturing the high-strength steel, a steel pipe which is composed of the high-strength steel, and a method for manufacturing the steel pipe. The present invention can be used for a high-strength steel pipe for a steam line.

BACKGROUND OF THE INVENTION

Examples of a method for recovering oil sand from an underground oil layer in, for example, Canada include an open-pit mining method and a steam injection method, in which high-temperature high-pressure steam is charged into an oil layer through steel pipes. Since there are only a small number of regions in which open-pit mining can be used, the steam injection method is used in many areas.

The temperature of steam which is charged into an oil layer in the steam injection method is in a temperature range of 300° C. to 400° C. (hereinafter, referred to as "a mid-temperature range"). In the steam injection method, steam having a temperature in the mid-temperature range is charged into an oil layer under high pressure. In order to charge steam, steel pipes are used as described above. Nowadays, in order to increase the recovery rate of heavy oil and in order to decrease laying costs in response to an increase in demand for energy, there is a demand for an increase in the diameter and strength of a steel pipe.

Examples of a conventional technique regarding a steel pipe for steam transportation which can be used for a steam injection method are described in Patent Literature 1 and Patent Literature 2. In Patent Literature 1 and Patent Literature 2, seamless steel pipes, having a strength equivalent to API grade X80 are described, and the maximum outer diameter of such seamless steel pipes is 16 inches.

Nowadays, regarding techniques for manufacturing a high-strength steel pipe in which a pipe is manufactured by performing welding and with which it is possible to increase the diameter of a steel pipe, Patent Literature 3 and Patent Literature 4 describe techniques with which a high-strength steel pipe having a strength of API grade X80 or higher is manufactured.

Patent Literature

PTL 1: Japanese Unexamined Patent Application Publication No. 2000-290728

PTL 2: Japanese Patent No. 4821939

PTL 3: Japanese Patent No. 5055736

PTL 4: International Publication No. WO2012/108027

SUMMARY OF THE INVENTION

In the case of Patent Literature 3, although high-temperature properties in the mid-temperature range are equivalent to grade X80, no consideration is given to strength properties when a pipe is used for a long time.

Patent Literature 4 describes an example of a technique for manufacturing high-strength steel of an API grade X100. However, in the case of the technique according to Patent Literature 4, it is necessary to use large amounts of alloy chemical elements in order to achieve satisfactory strength in the mid-temperature range.

In addition, in the case of the technique according to Patent Literature 4, it was clarified that there is a significant decrease in tensile strength when a pipe is held in the mid-temperature range for a long time.

An object of the present invention is to provide a technique with which it is possible to achieve a tensile strength of 620 MPa or more (API grade X80 or higher) which is required for a steel pipe of API grade X80 or higher even after long-term aging in a mid-temperature range.

It has been determined that, in a manufacturing process including controlled rolling followed by accelerated cooling and reheating, by performing reheating during bainite transformation on Nb-containing steel, in which Nb forms a solid solution, or Nb—V-containing steel, in which Nb and V form solid solutions, it is possible to inhibit a decrease in strength in the mid-temperature range not only through an increase in strength due to bainite transformation when accelerated cooling is performed but also through precipitation strengthening due to fine precipitates which are precipitated from bainite and untransformed austenite when reheating is performed and through the inhibition of dislocation recovery in the mid-temperature range.

In addition, in the case where TiN is present, Nb is less likely to form a solid solution. As a result, since fine Nb carbides are less likely to be dispersedly precipitated than in the case where Ti is not included when reheating is performed after accelerated cooling has been performed, it is difficult to inhibit a decrease in strength in the mid-temperature range. However, in the case where the value of $P_{eff}$ calculated by using equation (1) below is 0.070% or more, since sufficient amounts of fine Nb carbides and V carbides are dispersedly precipitated when reheating is performed even in the case where Ti is included, it is possible to inhibit a decrease in strength in the mid-temperature range.

$$P_{eff}(\%)=(0.13Nb+0.24V-0.125Ti)/(C+0.86N) \quad (1)$$

Here, the symbols of chemical elements in equation (1) respectively denote the contents (mass %) of the corresponding chemical elements. In addition, the symbol of a chemical element which is not included is assigned a value of 0.

In addition, Nb and V are chemical elements which form carbides in steel. The strength of steel is conventionally increased through the precipitation of NbC. In addition, since the coagulation and coarsening of V-based carbides are less likely to occur even when the V-based carbides are held at a high temperature for a long time, V is a chemical element which is effective for, for example, achieving satisfactory high-temperature creep strength. In embodiments according to the present invention, by increasing heating rate when reheating is performed after accelerated cooling has been performed, the growth of precipitates is inhibited when heating is performed. Basically, by finely precipitating large amounts of carbides containing Nb or Nb and V in steel through such inhibition, the effect of inhibiting a decrease in strength in the mid-temperature range is realized.

According to embodiments of the present invention, when reheating is performed after accelerated cooling has been performed, heating is performed in an atmospheric heating furnace at a higher heating rate than that which is conventionally and industrially used. Basically, with this, by inhibiting the growth of carbides containing Nb or Nb and V, large amounts of very fine precipitates having a grain size of less than 10 nm are formed.

Moreover, when the high-strength steel according to embodiments of the present invention is manufactured, in order to form a large number of dislocations in microstructure grains, accumulated rolling reduction ratio in a temperature range of 900° C. or lower and rolling finish temperature are controlled before fine carbides are dispersedly precipitated when reheating is performed after accelerated cooling has been performed. That is, when the high-strength steel according to embodiments of the present invention is manufactured, the number of dislocations is increased in grains in both of a rolling process and an accelerated cooling process.

As described above, according to embodiments of the present invention, high strength in the mid-temperature range is achieved as a result of an increase in the number of dislocations through the use of rolling and accelerated cooling and as a result of the inhibition of dislocation recovery in the mid-temperature range through the use of fine carbides which are dispersedly precipitated when heating is performed after accelerated cooling has been performed.

Embodiments of the present invention include:

[1] High-strength steel having a chemical composition containing, by mass %, C: 0.040% to 0.090%, Si: 0.05% to 0.30%, Mn: 1.50% to 2.50%, P: 0.020% or less, S: 0.002% or less, Mo: 0.20% to 0.60%, Nb: 0.020% to 0.070%, Ti: 0.020% or less, V: 0.080% or less, Al: 0.045% or less, N: 0.0100% or less, and the balance being Fe and inevitable impurities, in which parameter $P_{eff}$ calculated by using equation (1) below is 0.050% or more, satisfying the relationship $(TS_0-TS)/TS_0 \leq 0.050$, where TS is defined as tensile strength determined at a temperature of 350° C. after aging has been performed under the condition of a Larson-Miller parameter (LMP) of 15700, and where $TS_0$ is defined as tensile strength determined at a temperature of 350° C. before the aging is performed, and having toughness represented by a $vE_{-20}$ of 100 J or more in a weld heat-affected zone, which is formed when welding is performed.

$$P_{eff}(\%)=(0.13Nb+0.24V-0.125Ti)/(C+0.86N) \quad (1)$$

Here, the symbols of elements in equation (1) respectively denote the contents (mass %) of the corresponding chemical elements. In addition, the symbol of a chemical element which is not included is assigned a value of 0.

[2] The high-strength steel according to item [1], in which Ti/N is 2.0 to 4.0, and X calculated by using equation (2) is 0.70% or more.

$$X=0.35Cr+0.9Mo+12Nb+8V \quad (2)$$

Here, the symbols of elements in equation (2) respectively denote the contents (mass %) of the corresponding chemical elements. In addition, the symbol of a chemical element which is not included is assigned a value of 0.

[3] The high-strength steel according to item [1] or [2], the high-strength steel having the chemical composition further containing, by mass %, one, two, or more of Cu: 0.5% or less, Ni: 0.5% or less, Cr: 0.5% or less, and Ca: 0.0005% to 0.004% and a bainite phase fraction of 70% or more.

[4] A steel pipe composed of the high-strength steel according to any one of items [1] to [3].

[5] A method for manufacturing the high-strength steel according to any one of items [1] to [3], the method including a heating process in which a steel raw material is heated to a temperature of 1050° C. to 1200° C., a hot rolling process in which the steel raw material, which has been heated in the heating process, is hot-rolled under the conditions of an accumulated rolling reduction ratio in a temperature range of 900° C. or lower of 50% or more and a rolling finish temperature of 850° C. or lower, an accelerated cooling process in which the hot-rolled steel plate, which has been obtained in the hot rolling process, is subjected to accelerated cooling under the conditions of a cooling rate of 5° C./s or more and a cooling stop temperature of 250° C. to 550° C., and a reheating process in which the hot-rolled steel plate is reheated, immediately after the accelerated cooling has been finished, under the conditions of a heating rate of 0.5° C./s or more and an end-point temperature of 550° C. to 700° C.

[6] A method for manufacturing a steel pipe, the method including a cold forming process in which a steel plate composed of the high-strength steel according to any one of items [1] to [3] is subjected to cold forming so as to be formed into a pipe shape and a welding process in which butt portions of the steel plate, which has been formed into a pipe shape in the cold forming process, are welded.

According to embodiments the present invention, even in the case where there is an increase in the diameter of a steel pipe, it is possible to obtain a steel pipe having a tensile strength of 620 MPa or more after the steel pipe has been held in the mid-temperature range for a long time.

In addition, according to embodiments of the present invention, it is possible to obtain a steel pipe having the properties described above even if the amount of alloy chemical elements used is decreased in order to decrease manufacturing costs.

DETAILED DESCRIPTION OF THE INVENTION

Embodiments of the present invention will be described hereafter. Here, the present invention is not limited to the embodiments below.

<High-Strength Steel>

The high-strength steel according to embodiments of the present invention has a chemical composition containing, by mass %, C: 0.040% to 0.090%, Si: 0.05% to 0.30%, Mn: 1.50% to 2.50%, P: 0.020% or less, S: 0.002% or less, Mo: 0.20% to 0.60%, Nb: 0.020% to 0.070%, Ti: 0.020% or less, V: 0.080% or less, Al: 0.045% or less, and N: 0.010% or less. In the description below, "%" used when describing a chemical composition means "mass %".

C: 0.040% to 0.090%

C is a chemical element which is necessary for achieving satisfactory strength of steel through solid solution strengthening and precipitation strengthening. In particular, an increase in the amount of solute C and the formation of precipitates are important for achieving satisfactory strength in the mid-temperature range. Since it is possible to achieve the specified strength at room temperature and in the mid-temperature range in the case where the C content is 0.040% or more, the C content is set to be 0.040% or more, or preferably 0.050% or more. Since there is a decrease in toughness and weldability in the case where the C content is more than 0.09%, the C content is set to be 0.090% or less, or preferably 0.080% or less.

Si: 0.05% to 0.30%

Si is added for the purpose of deoxidizing. Since it is not possible to realize a sufficient deoxidizing effect in the case where the Si content is less than 0.05%, it is preferable that the Si content be 0.05% or more. On the other hand, since there is a decrease in toughness in the case where the Si content is more than 0.30%, the Si content is set to be 0.30% or less, or preferably 0.20% or less. It is preferable that the Si content be 0.05% to 0.20% in order to achieve a strength of API grade X100 or higher.

Mn: 1.50% to 2.50%

Mn is a chemical element which is effective for increasing the strength and toughness of steel. It is possible to sufficiently realize such an effect in the case where the Mn content is 1.50% or more. In addition, there is a significant decrease in toughness and weldability in the case where the Mn content is more than 2.50%. Therefore, the Mn content is set to be 1.50% to 2.50%. It is preferable that the Mn content be 2.00% or less.

P: 0.020% or less

P is an impurity chemical element and significantly decreases toughness. Therefore, it is preferable that the P content be as small as possible. However, there is an increase in manufacturing costs in the case where the P content is excessively decreased. Therefore, the P content is set to be 0.020% or less, or preferably 0.010% or less.

S: 0.002% or less

S is an impurity chemical element and may significantly decrease toughness. Therefore, it is preferable that the S content be as small as possible. In addition, even if morphological control from MnS to CaS-based inclusions is performed by adding Ca, finely dispersed CaS-based inclusions may cause a decrease in toughness in the case of a high-strength material of grade X80 or higher. Therefore, the S content is set to be 0.002% or less, or preferably 0.001% or less.

Mo: 0.20% to 0.60%

Mo significantly contributes to an increase in strength at room temperature and in the mid-temperature range by forming a solid solution or precipitates. However, in the case where the Mo content is less than 0.2%, it is not possible to achieve sufficient strength in the mid-temperature range. Therefore, the Mo content is set to be 0.20% or more, or preferably 0.25% or more. On the other hand, since there is a decrease in toughness and weldability in the case where the Mo content is more than 0.60%, the Mo content is set to be 0.60% or less, or preferably 0.50% or less.

Nb: 0.020% to 0.070%

Nb is a chemical element which is important in embodiments of the present invention. Specifically, Nb is a chemical element which forms carbides and is necessary for achieving satisfactory strength at room temperature and in the mid-temperature range. In addition, Nb is necessary for achieving sufficient strength and toughness by inhibiting the growth of crystal grains when slab heating and rolling are performed in order to form a fine microstructure. Since such an effect is significant in the case where the Nb content is 0.020% or more, the Nb content is set to be 0.020% or more, or preferably 0.030% or more. In the case where the Nb content is more than 0.07%, such an effect becomes almost saturated, and there is a decrease in toughness. Therefore, the Nb content is set to be 0.070% or less, or preferably 0.065% or less.

Ti: 0.020% or less

Ti inhibits grain growth by forming TiN when slab heating is performed or in a weld heat-affected zone. In such a manner, Ti is effective for increasing toughness by contributing to the formation of a fine microstructure. In order to realize such an effect, it is preferable that the Ti content be 0.005% or more. In the case where the Ti content is more than 0.020%, since fine carbides are less likely to be dispersedly precipitated due to the existence of TiN, it is difficult to inhibit a decrease in strength in the mid-temperature range. Therefore, the Ti content is set to be 0.020% or less, or preferably 0.015% or less.

V: 0.080% or less

V contributes to an increase in strength by forming compound precipitates in combination with Ti and Nb. In addition, since the coagulation and coarsening of V-based carbides are less likely to occur even when the carbides are held at a high temperature for a long time, V is a chemical element which is effective for, for example, achieving satisfactory high-temperature creep strength. In order to realize such effects, it is preferable that the V content be 0.010% or more. In the case where the V content is more than 0.080%, there is a decrease in the toughness of a weld heat-affected zone. Therefore, the V content is set to be 0.080% or less, or preferably 0.050% or less. Here, in the case where it is possible to realize the effects described above, which are realized by adding V, by adding chemical elements other than V, the high-strength steel according to embodiments of the present invention need not contain V.

Al: 0.045% or less

Al is added as a deoxidizing agent. In order to realize such an effect as a deoxidizing agent, it is preferable that the Al content be 0.020% or more. In the case where the Al content is more than 0.045%, since there is a decrease in the cleanliness of steel, there is a decrease in toughness. Therefore, the Al content is set to be 0.045% or less.

N: 0.010% or less

N combines with Ti to form TiN. TiN is finely dispersed in a weld heat-affected zone which is heated to a high temperature of 1350° C. or higher. As a result of such fine dispersion, since there is a decrease in the grain size of prior austenite in a weld heat-affected zone, there is an increase in the toughness of a weld heat-affected zone. In order to realize such an effect, it is preferable that the N content be 0.0020% or more. In addition, in the case where the N content is more than 0.010%, since there is a decrease in the toughness of a base metal due to coarsening of the grains of precipitates and an increase in the amount of solute N, there is a decrease in the toughness of a weld metal in the steel pipe state. Therefore, the N content is set to be 0.010% or less, or preferably 0.006% or less. It is preferable that the N content be 0.006% or less in order to achieve a strength of API grade X100 or higher.

$P_{eff}$ (%) 0.050% or more $P_{eff}$ is defined by the formula (0.13Nb+0.24V−0.125Ti)/(C+0.86N). In this formula, the symbols of elements respectively denote the contents (mass %) of the corresponding chemical elements, and the symbol of a chemical element which is not included is assigned a value of 0. In embodiments of the present invention, it is necessary to control the contents of the relevant chemical elements described above so that $P_{eff}$ is 0.050% or more. $P_{eff}$ is a factor which is important for controlling steel having the chemical composition described above to be steel having excellent strength in the mid-temperature range. In the case where $P_{eff}$(%) is less than 0.050%, there is a decrease in the amount of finely dispersed carbides which are precipitated when reheating is performed after cooling has been performed. As a result, there is a significant decrease in strength, in particular, tensile strength after a long-term heat treatment has been performed. Therefore, $P_{eff}$(%) is set to be 0.050% or more, and it is preferable that $P_{eff}$(%) be 0.070% or more in order to sufficiently inhibit a decrease in strength after a heat treatment has been performed. In addition, since there is a decrease in toughness due to a large amount of precipitates formed in a weld heat-affected zone in the case where $P_{eff}$ is large, it is preferable that $P_{eff}$ be 0.280% or less. It is preferable that $P_{eff}$ be 0.070% or more in order to achieve a strength of API grade X100 or higher.

The high-strength steel according to embodiments of the present invention may contain one, two, or more of Cu, Ni, Cr, and Ca in order to further improve properties.

Cu: 0.50% or less

Cu is one of the chemical elements which are effective for increasing toughness and strength. In order to realize such effects, it is preferable that the Cu content be 0.05% or more. In the case where the Cu content is more than 0.50%, there is a decrease in weldability. Therefore, in the case where Cu is included, the Cu content is set to be 0.50% or less.

Ni: 0.50% or less

Ni is one of the chemical elements which are effective for increasing toughness and strength. In order to realize such effects, it is preferable that the Ni content be 0.05% or more. In the case where the Ni content is more than 0.50%, such effects become saturated, and there is an increase in manufacturing costs. Therefore, in the case where Ni is included, the Ni content is set to be 0.50% or less.

Cr: 0.50% or less

Cr is one of the chemical elements which are effective for increasing strength. In order to realize such an effect, it is preferable that the Cr content be 0.05% or more. In the case where the Cr content is more than 0.50%, there is a negative effect on weldability. Therefore, in the case where Cr is included, the Cr content is set to be 0.50% or less.

Ca: 0.0005% to 0.0040%

Ca increases toughness by controlling the shape of sulfide-based inclusions. Such an effect is realized in the case where the Ca content is 0.0005% or more. In the case where the Ca content is more than 0.004%, such an effect becomes saturated, and there is a decrease in toughness due to a decrease in cleanliness. Therefore, in the case where Ca is included, the Ca content is set to be 0.0005% to 0.0040%.

Cu+Ni+Cr+Mo: 1.50% or less

It is preferable that Cu+Ni+Cr+Mo (the symbols of elements respectively denote the contents of the corresponding chemical elements, and the symbol of a chemical element which is not included is assigned a value of 0) be 1.50% or less. These chemical elements contribute to an increase in strength, and properties are improved in the case where the contents of these chemical elements are increased. However, it is preferable that the upper limit of the total contents of the relevant chemical element described above be 1.50% or less, more preferably 1.20% or less, or even more preferably 1.00% or less, in order to control manufacturing costs to be low. Here, it is one of the features of embodiments of the present invention that it is possible to achieve the desired properties even in the case where the amount of these chemical elements used is limited. It is preferable that this condition be satisfied in order to achieve a strength of API grade X100 or higher.

Ti/N: 2.0 to 4.0

By specifying Ti/N within an appropriate range, since TiN is finely dispersed, it is possible to decrease the grain size of prior austenite in a weld heat-affected zone. As a result of such refinement, there is an increase in the toughness of a weld heat-affected zone in a low temperature range of −20° C. or lower and in the mid-temperature range of 300° C. or higher. Since such an effect is not sufficiently realized in the case where Ti/N is less than 2.0, Ti/N is set to be 2.0 or more, or preferably 2.4 or more. In the case where Ti/N is more than 4.0, there is an increase in the grain size of prior austenite due to an increase in the grain size of precipitates. As a result of such coarsening, there is a decrease in the toughness of a weld heat-affected zone. Therefore, Ti/N is set to be 4.0 or less, or preferably 3.8 or less.

X=0.35Cr+0.9Mo+12Nb+8V (2): 0.70% or more, where Cr, Mo, Nb, and V: expressed in units of mass %

The equation above, which expresses X, contributes to intra-grain precipitation strengthening during rolling by increasing temper softening resistance of steel having the chemical composition described above. Equation (2) is an important factor for obtaining steel having an excellent strength of grade X80 or higher in the mid-temperature range after a long-term heat treatment has been performed and good low-temperature toughness, and it is preferable that X be 0.70% or more in embodiments of the present invention. In combination with the manufacturing conditions described below, the effect of satisfying the condition regarding equation (2) is significantly realized. It is preferable that X be 0.70% or more, or more preferably 0.75% or more, in order to achieve a strength of grade X80 after a long-term heat treatment at a temperature of 350° C. has been performed. It is preferable that X be 0.90% or more, or more preferably 1.00% or more, in order to achieve a strength of grade X100 after a long-term heat treatment at a temperature of 350° C. has been performed. In addition, in the case where X is 2.0% or more, there may be a decrease in the low-temperature toughness of a welded zone. Therefore, it is preferable that X be less than 2.0%, more preferably less than 1.8%, or even more preferably less than 1.6%.

Hereafter, the microstructure of the high-strength steel according to embodiments of the present invention will be described. Although there is no particular limitation on the microstructure of the high-strength steel according to embodiments of the present invention, it is preferable that a bainite phase fraction be 70% or more in terms of area ratio. This is because it is possible to achieve a satisfactory strength-toughness balance in the case where the bainite phase fraction is 70% or more. In addition, although there is no particular limitation on the upper limit of the bainite phase fraction, it is preferable that the bainite phase fraction be 95% or less in order to increase deformation capability. Here, among phases other than bainite, for example, ferrite, pearlite, martensite, and a martensite-austenite constituent (MA) may be included in an amount of 30% or less in total in terms of area ratio.

$$(TS_0-TS)/TS_0 \leq 0.050$$

In embodiments of the present invention, the relationship $(TS_0-TS)/TS_0 \leq 0.050$ is satisfied, where TS is defined as tensile strength determined at a temperature of 350° C. after aging has been performed under the condition of a Larson-Miller Parameter (LMP) of 15700, and where $TS_0$ is defined as tensile strength determined at a temperature of 350° C. before the above-mentioned aging is performed. $(TS_0-TS)/TS_0$ is an index with which a decrease in tensile strength when steel is held in the mid-temperature range for a long time is evaluated. In the case where this index is 0.050 or less, a decrease in tensile strength after steel is held in the mid-temperature range for a long time is within a range in which there is no practical problem.

Toughness of weld heat-affected zone: $vE_{-20}$ of 100 J or more

The toughness of a weld heat-affected zone (HAZ) which is formed when the high-strength steel according to embodiments of the present invention is welded to another steel is represented by a $vE_{-20}$, which denotes absorbed energy when a Charpy impact test is performed at a test temperature of −20° C., of 100 J or more. In the case where the $vE_{-20}$ is 100 J or more, it is possible to achieve the toughness which is required for a structural pipe. Here, the notch of a Charpy impact test specimen is formed at a position located on the base metal side 3 mm from a bond (HAZ 3 mm) which is the boundary of a weld metal and a base metal. In addition, a case where, by performing a Charpy impact test on three test specimens for each condition, the average value of the absorbed energy ($vE_{-20}$) of the three test specimens is 100 J or more is judged as a case within the range according to embodiments of the present invention.

In addition, the high-strength steel according to embodiments of the present invention has a yield strength determined at a temperature of 350° C. of 555 MPa or more and a tensile strength determined at a temperature of 350° C. of 620 MPa or more. In addition, the steel has a tensile strength of 620 MPa or more after having been subjected to long-term aging in the mid-temperature range. It is possible to achieve such excellent properties by controlling the chemical composition to be within the specified range and by using the manufacturing conditions described below.

<Steel Pipe>

The steel pipe according to embodiments of the present invention is composed of the high-strength steel according to embodiments of the present invention described above. Since the steel pipe according to embodiments of the present invention is composed of the high-strength steel according to embodiments of the present invention, the steel pipe has strength properties which are required for a high-strength welded steel pipe for steam transportation even if the steel pipe has a large diameter.

The term "a large diameter" means a case where a steel pipe has an outer diameter (full diameter) of 400 mm or more. Especially, according to embodiments of the present invention, it is possible to sufficiently increase the above-mentioned outer diameter to 813 mm while maintaining the strength properties which are required for a high-strength welded steel pipe for steam transportation.

In addition, although there is no particular limitation on the thickness of a steel pipe, the thickness is 15 mm to 30 mm in the case of a steel pipe for steam transportation.

<Method for Manufacturing High-Strength Steel>

The method for manufacturing high-strength steel according to embodiments of the present invention includes a heating process, a hot rolling process, an accelerated cooling process, and a reheating process. The term "a temperature" used when describing each of the processes means the average temperature in the thickness direction of a steel plate, unless otherwise noted. It is possible to determine the average temperature in the thickness direction by performing calculation through the use of a heat-transfer calculation method, such as a finite difference method, which utilizes parameters such as the thickness and the thermal conductivity, from the surface temperature of a slab or a steel plate. In addition, the term "a cooling rate" means an average cooling rate which is calculated by dividing a difference in temperature between a hot rolling finish temperature and a cooling stop (finish) temperature by the time required to perform cooling. In addition, the term "a reheating rate (heating rate)" means an average heating rate which is calculated by dividing a difference in temperature between the cooling stop temperature and a reheating temperature by the time required to perform reheating after cooling has been performed.

Heating Process

The heating process is a process in which a steel raw material is heated to a temperature of 1050° C. to 1200° C. Here, examples of "a steel raw material" include a slab. Since the chemical composition of the steel raw material becomes the chemical composition of high-strength steel, the chemical composition of the high-strength steel may be controlled when the chemical composition of the slab is controlled. Here, there is no particular limitation on the method used for manufacturing the steel raw material. It is preferable that the steel slab be manufactured by using a steel making process which utilizes a converter and a casting process which utilizes a continuous casting method from the viewpoint of economic efficiency.

In order to achieve sufficient strength at room temperature and in the mid-temperature range by sufficiently progressing the formation of austenite and the solid solution of carbides when hot rolling is performed, the heating temperature is set to be 1050° C. or higher. On the other hand, in the case where the heating temperature is higher than 1200° C., since austenite grains significantly grow, there is a decrease in the toughness of a base metal. Therefore, the heating temperature is set to be 1050° C. to 1200° C.

Hot Rolling Process

The hot rolling process is a process in which the steel raw material which has been heated in the heating process is subjected to hot rolling under the conditions of an accumulated rolling reduction ratio in a temperature range of 900° C. or lower of 50% or more and a rolling finish temperature of 850° C. or lower.

This process relates to the important manufacturing conditions according to embodiments of the present invention. By performing rolling in a temperature range 900° C. or lower and by controlling the rolling finish temperature to be 850° C. or lower, austenite grains are elongated so as to have a small grain size in the thickness and width direction of a steel plate, and there is an increase in the density of dislocations which are introduced to the inside of the grains through rolling.

Such effects are realized in the case where the accumulated rolling reduction ratio in a temperature range of 900° C. or lower is controlled to be 50% or more and the rolling finish temperature is controlled to be 850° C. or lower. As a result, there is an increase in strength, in particular, strength in the mid-temperature range and there is a significant increase in toughness.

In the case where the accumulated rolling reduction ratio in a temperature range of 900° C. or lower is less than 50% or where the rolling finish temperature is higher than 850° C., there is insufficient decrease in the grain size of austenite, and there is an insufficient increase in the number of dislocations introduced to the inside of the grains. As a result, there is a decrease in strength and toughness in the mid-temperature range. Therefore, the accumulated rolling reduction ratio in a temperature range of 900° C. or lower is set to be 50% or more, and the rolling finish temperature is set to be 850° C. or lower.

Here, although there is no particular limitation on the upper limit of the accumulated rolling reduction ratio described above, it is preferable that the accumulated rolling reduction ratio be 80% or less in order to prevent a decrease in the toughness of a base metal due to the growth of a deformation texture. In addition, there is no particular limitation on the lower limit of the rolling finish temperature described above, it is preferable that the rolling finish temperature allow to form a fine microstructure by increasing the rolling reduction in a perfect non-recrystallization temperature range, such as 750° C. or higher.

Accelerated Cooling Process

The accelerated cooling process is a process in which the hot-rolled steel plate obtained in the hot rolling process is subjected to accelerated cooling under the conditions of a cooling rate of 5° C./s or more and a cooling stop temperature of 250° C. to 550° C.

There is a tendency for the strength of steel to increase with an increase in cooling rate in accelerated cooling. In the case where the cooling rate when accelerated cooling is performed is less than 5° C./s, the transformation of steel starts at a high temperature, and dislocation recovery progresses during cooling. Therefore, in the case where the cooling rate when accelerated cooling is performed is less than 5° C./s, it is not possible to achieve sufficient strength at room temperature or in the mid-temperature range. Therefore, the cooling rate when accelerated cooling is performed is set to be 5° C./s or more.

There is a tendency for the strength of steel to increase with a decrease in cooling stop temperature in accelerated cooling. In the case where the cooling stop temperature of accelerated cooling is higher than 550° C., since the growth of carbides is promoted, there is a decrease in the amount of solute carbon. As a result, it is not possible to achieve sufficient strength, in particular, sufficient strength in the mid-temperature range.

In the case where the cooling stop temperature is lower than 250° C., there is a decrease in the toughness of a base metal due to low-temperature-transformation products being significantly precipitated, and there is a significant decrease in strength in the mid-temperature range due to the decomposition of the low-temperature-transformation products in the mid-temperature range. Therefore, the cooling stop temperature in accelerated cooling is set to be 250° C. to 550° C.

Reheating Process

The reheating process is a process in which the hot-rolled steel plate is reheated under the conditions of a heating rate of 0.5° C./s or more and an end-point temperature of 550° C. to 700° C. immediately after accelerated cooling has been performed. Here, the term "immediately after accelerated cooling has been performed" means "within 150 seconds, or preferably within 120 seconds, after the cooling stop temperature has been reached".

This process, which is performed under the conditions of a heating rate after accelerated cooling has been performed of 0.5° C./s or more and an end-point temperature of 550° C. to 700° C., is important in embodiments of the present invention. By performing this process, it is possible to precipitate fine precipitates, which contribute to an increase in strength at room temperature and in the mid-temperature range, when reheating is performed. In order to form fine precipitates, it is necessary to perform reheating to a temperature range of 550° C. to 700° C. immediately after accelerated cooling has been performed. Here, in the reheating process, it is not necessary to specify a temperature-holding time. In addition, since precipitation progresses along with bainite transformation also in a cooling process after reheating has been performed, a cooling after reheating has been performed is basically natural cooling.

In the case where the heating rate is less than 0.5° C./s, since a long time is required to reach the target reheating temperature, there is a decrease in manufacturing efficiency. In addition, in the case where the heating rate is less than 0.5° C./s, since it is not possible to realize the dispersed precipitation of fine precipitates due to the growth of precipitates, it is not possible to achieve sufficient strength. Therefore, the heating rate is set to be 0.5° C./s or more, or preferably 5.0° C./s or more.

In the case where the reheating temperature is lower than 550° C., since the temperature is out of a range in which Mo, Nb, and V are precipitated, it is not possible to sufficiently realize the effect of precipitation strengthening. Therefore, the reheating temperature is set to be 550° C. or higher, or preferably 600° C. or higher. On the other hand, in the case where the reheating temperature is higher than 700° C., since there is coarsening of the grains of precipitates, it is not possible to achieve sufficient strength at room temperature and in the mid-temperature range. Therefore, the reheating temperature is set to be 700° C. or lower, or preferably 680° C. or lower.

Here, it is difficult to realize a heating rate of 0.5° C./s or more, which is specified in embodiments of the present invention, in an atmospheric heating furnace depending on the thickness of a steel plate after accelerated cooling has been performed. Therefore, examples of a preferable heating device include a gas burner furnace and an induction heating device, with which it is possible to rapidly heat a steel plate. In addition, it is more preferable that such a gas heating furnace or an induction heating device be installed on a carrier line located downstream of a cooling device used for accelerated cooling.

In the case of an induction heating device, temperature control is easier than in the case of, for example, a soaking furnace, and cost is comparatively low. In addition, an induction heating device is particularly preferable, because it is possible to rapidly heat a steel plate after cooling has been performed. In addition, by continuously arranging plural induction heating devices in series, it is possible to freely control heating rate and reheating temperature only by arbitrarily setting the number of induction heating devices energized and applied power even in the case where line speed or the kind or size of a steel plate varies.

Here, it is basically preferable that a cooling rate after reheating has been performed be equivalent to that of natural cooling.

<Method for Manufacturing Steel Pipe>

In embodiments of the present invention, a steel pipe is manufactured from the steel plate which is manufactured by using the method described above.

In the case where a steel pipe for steam transportation is manufactured, it is preferable that the thickness of the above-described steel plate be 15 mm to 30 mm:

Examples of a method for forming a steel pipe include a UOE process and a press bend method (also referred to as "bending press method") in which cold forming is performed in order to obtain a steel-pipe shape.

In the case of a UOE process, by performing groove cutting on the ends in the width direction of a steel plate as a raw material, followed by performing crimping on the ends in the width direction of the steel plate and forming the steel plate into an O shape through a U shape through the use of a pressing machine, the steel plate is formed into a circular cylinder shape so that the ends in the width direction of the steel plate face each other. Subsequently, the ends in the width direction of the steel plate are arranged so as to butt each other and welded. Such welding is called "seam welding". It is preferable that such a seam welding process include two processes, that is, a tack welding process in which tack welding is performed on the ends in the width direction of the steel plate which butt against each other while the steel plate having a circular cylinder shape is constrained and a final welding process in which submerged arc welding is performed on the inner and outer surfaces of butt portions of the steel plate. After seam welding has been performed, expansion is performed in order to remove welding residual stress and in order to increase the roundness of the steel pipe. In an expanding process, expansion is usually performed with an expansion ratio (the ratio of the amount of change in outer diameter before and after expansion is performed to the outer diameter of the pipe before expansion is performed) of 0.3% to 1.5%. It is preferable that the expansion ratio be 0.5% to 1.2% from the viewpoint of the balance between the effect of increasing roundness and the capacity which is required for an expander.

In the case of a press bend method, by repeatedly performing 3-point bending on a steel plate in order to form the steel plate step by step, a steel pipe having an approximately circular cross section is manufactured. Subsequently, as is the case with the UOE process described above, seam welding is performed. Also, in the case of a press bend method, expansion may be performed after seam welding has been performed.

EXAMPLES

After having performed cold forming on steel plates (having the thicknesses given in Table 2) which had been manufactured under the conditions given in Table 2 from the steels A through Q having the chemical compositions given in Table 1, steel pipes having the outer diameters and pipe wall thicknesses (plate thicknesses) given in Table 2 were manufactured by performing seam welding. Here, in Table 2, the term "Rolling Reduction Ratio" means accumulated rolling reduction ratio in a temperature range of 900° C. or lower, the term "Finish Temperature" means rolling finish temperature, and the term "Stop Temperature" means cooling stop temperature.

By taking a sample for steel microstructure observation from the central portion in the width direction of the steel plate (steel plate which had not been formed into a steel pipe) which had been manufactured as described above, and by performing mirror polishing on a cross section in the thickness direction parallel to the rolling longitudinal direction followed by performing nital etching on the cross section, a microstructure was exposed. Subsequently, after having obtained steel microstructure photographs in five fields of view selected at random through the use of an optical microscope at a magnification of 400 times, bainite phase fraction was determined in the photographs through the use of an image interpretation device. The results are given in Table 2.

Regarding the properties of the steel plate, a tensile test was performed at a temperature of 350° C. on a round-bar-form test piece having a diameter of 6 mm. Tensile strength and yield strength were determined. The results are given in Table 2. Here, the properties of the steel plate was determined by using a test piece which had been taken from the steel plate which had not been formed into a steel pipe.

Regarding the properties of the steel pipe, by taking a tensile test piece in the circumferential direction, yield strength and tensile strength were determined at a temperature of 350° C. A tensile test at a temperature of 350° C. was performed on a round-bar-form test piece having a diameter of 6 mm. The results are given in Table 2.

In addition, in order to simulate high-temperature strength after steel has been held in the mid-temperature range for a long time, after having performed a heat treatment under the condition of a Larson-Miller parameter, which is a tempering parameter calculated by using equation (2), of 15700 (450° C. and 50 hours) which is equivalent to a case where the steel has been held at a temperature of 350° C., which is a temperature at which a steam line is used, for 20 years, yield strength and tensile strength at a temperature of 350° C. were determined. Here, the determination described above was performed on both the steel plate and the steel pipe as done before the heat treatment was performed, and the results are given in Table 2.

$$LMP=(T+273)\times(20+\log(t)) \quad (2)$$

Here, T denotes a heat treatment temperature (° C.), and t denotes a heat treatment time (sec).

In addition, in order to evaluate whether the amount of decrease in tensile strength was small when the steel had been held in the mid-temperature range for a long time, regarding the tensile strength of the steel pipe, by calculating ((tensile strength before heat treatment ($TS_0$))−(tensile strength after heat treatment (TS)))/tensile strength before heat treatment ($TS_0$), a case where the calculated value was 0.050 or less was judged as good.

The toughness of a weld heat-affected zone (HAZ) was evaluated by performing a Charpy impact test. The notch of a Charpy impact test specimen was formed at a position located on the base metal side 3 mm from a bond (HAZ 3 mm) which is the boundary of a weld metal and a base metal. The test was performed at a temperature of −20° C. In embodiments of the present invention, a case where, by performing a Charpy impact test on three test specimens for each condition, the average value of the absorbed energy ($vE_{-20}$) at a temperature of −20° C. of the three test specimens was 100 J or more was judged as a case of excellent toughness. The results are given in Table 2.

As described above, the manufacturing conditions of the steel plates and the test results of the steel plates and the steel pipes are given in combination in Table 2.

In the case of the example steels (1 through 9) of the present invention, whose chemical compositions and steel-plate-manufacturing conditions were all within the range according to embodiments of the present invention, the steel plates and the steel pipes had a yield strength of 555 MPa or more and a tensile strength of 620 MPa or more (determined at a temperature of 350° C.) before and after the heat treatment had been performed. In addition, in the case of the example steels (1 through 9) of the present invention, the results regarding both of the toughness of a HAZ and $(TS_0-TS)/TS_0$ were good.

TABLE 1

| Steel Code | C | Si | Mn | P | S | Mo | Nb | Ti | V | Al | N | Cu |
|---|---|---|---|---|---|---|---|---|---|---|---|---|
| A | 0.075 | 0.28 | 1.75 | 0.008 | 0.001 | 0.32 | 0.053 | 0.007 | | 0.023 | 0.0026 | |
| B | 0.055 | 0.11 | 2.02 | 0.009 | 0.001 | 0.28 | 0.030 | 0.010 | 0.005 | 0.014 | 0.0040 | |
| C | 0.056 | 0.05 | 1.85 | 0.004 | 0.002 | 0.31 | 0.040 | 0.012 | | 0.031 | 0.0041 | 0.25 |
| D | 0.062 | 0.15 | 1.81 | 0.009 | 0.001 | 0.25 | 0.036 | 0.009 | 0.010 | 0.029 | 0.0036 | 0.15 |
| E | 0.050 | 0.25 | 1.75 | 0.004 | 0.001 | 0.21 | 0.042 | 0.011 | | 0.031 | 0.0033 | |

TABLE 1-continued

| | | | | | | | | | | | | |
|---|---|---|---|---|---|---|---|---|---|---|---|---|
| F | 0.060 | 0.15 | 1.80 | 0.010 | 0.001 | 0.45 | 0.038 | 0.011 | 0.020 | 0.043 | 0.0036 | |
| G | 0.070 | 0.15 | 1.92 | 0.010 | 0.001 | 0.35 | 0.040 | 0.010 | 0.030 | 0.043 | 0.0033 | |
| H | 0.070 | 0.11 | 1.90 | 0.008 | 0.001 | 0.32 | 0.048 | 0.010 | 0.045 | 0.045 | 0.0035 | 0.25 |
| I | 0.075 | 0.10 | 1.62 | 0.009 | 0.001 | 0.41 | 0.024 | 0.010 | 0.075 | 0.014 | 0.0044 | |
| **J** | **0.095** | 0.07 | 1.52 | 0.010 | 0.001 | 0.20 | 0.030 | 0.007 | 0.030 | 0.038 | 0.0028 | |
| **K** | 0.056 | **0.32** | 1.99 | 0.010 | 0.001 | 0.30 | 0.040 | 0.009 | | 0.025 | 0.0031 | 0.25 |
| **L** | 0.060 | 0.15 | 1.75 | 0.010 | 0.002 | 0.28 | **0.075** | 0.009 | | 0.032 | 0.0038 | |
| **M** | 0.071 | 0.18 | 1.74 | 0.013 | 0.002 | 0.26 | 0.025 | **0.021** | 0.030 | 0.035 | 0.0048 | |
| **N** | 0.064 | 0.24 | 1.80 | 0.008 | 0.001 | 0.25 | **0.005** | 0.012 | 0.050 | 0.024 | 0.0041 | 0.15 |
| **O** | 0.060 | 0.15 | 1.81 | 0.009 | 0.001 | 0.25 | 0.040 | 0.016 | | 0.028 | 0.0058 | 0.20 |
| **P** | 0.060 | 0.30 | 1.95 | 0.010 | 0.001 | 0.30 | 0.025 | 0.015 | 0.010 | 0.038 | 0.0053 | 0.50 |
| **Q** | 0.060 | 0.15 | 1.81 | 0.009 | 0.001 | 0.25 | 0.040 | **0.022** | | 0.028 | 0.0058 | 0.29 |

| Steel Code | Ni | Cr | Ca | P_eff. | X | Ti/N | Note |
|---|---|---|---|---|---|---|---|
| A | | | 0.0021 | 0.078 | 0.92 | 2.7 | Example Steel |
| B | | 0.28 | 0.0023 | 0.066 | 0.75 | 2.5 | Example Steel |
| C | 0.26 | | 0.0026 | 0.062 | 0.76 | 2.9 | Example Steel |
| D | 0.15 | 0.05 | 0.0021 | 0.091 | 0.75 | 2.5 | Example Steel |
| E | 0.20 | 0.40 | 0.0026 | 0.077 | 0.83 | 3.3 | Example Steel |
| F | | | 0.0017 | 0.133 | 1.02 | 3.1 | Example Steel |
| G | 0.30 | | 0.0018 | 0.153 | 1.04 | 3.0 | Example Steel |
| H | 0.25 | | 0.0026 | 0.216 | 1.22 | 2.9 | Example Steel |
| I | | 0.40 | 0.0020 | 0.252 | 1.40 | 2.3 | Example Steel |
| **J** | | | 0.0020 | 0.105 | 0.78 | 2.5 | Comparative Steel |
| **K** | 0.25 | | 0.0021 | 0.069 | 0.75 | 2.9 | Comparative Steel |
| **L** | | 0.30 | 0.0030 | 0.136 | 1.26 | 2.4 | Comparative Steel |
| **M** | | | 0.0018 | 0.104 | 0.77 | **4.4** | Comparative Steel |
| **N** | 0.15 | | 0.0024 | 0.165 | **0.69** | 2.9 | Comparative Steel |
| **O** | 0.21 | 0.23 | 0.0021 | **0.049** | 0.79 | 2.8 | Comparative Steel |
| **P** | 0.50 | | 0.0021 | 0.058 | **0.65** | 2.8 | Comparative Steel |
| **Q** | 0.21 | 0.23 | 0.0021 | **0.038** | 0.79 | 3.8 | Comparative Steel |

Annotation: An underlined portion written in bold indicates a value out of the range according to the present invention.

Annotation: P_eff. = (0.13Nb + 0.24V − 0.125Ti)/(C + 0.86N)

The symbols of elements respectively denote the contents (mass %) of the corresponding alloy chemical elements.

TABLE 2

| | | | | Steel Plate Manufacturing Condition | | | | | | | Yield Strength [Steel Plate] (MPa) | |
|---|---|---|---|---|---|---|---|---|---|---|---|---|
| | | | Outer | Heating | Hot Rolling Process | | Accelerated Cooling | | | | | |
| | | | Diameter | Process | Rolling | | Process | | Reheating Process | | before | after |
| No. | Steel | Thickness (mm) | of Pipe (mm) | Heating Temperature | Reduction Ratio | Finish Temperature | Cooling Rate | Stop Temperature | Heating Rate | End-point Temperature | Heat Treatment | Heat Treatment |
| 1 | A | 20 | 813 | 1200 | 75 | 820 | 25 | 450 | 31 | 650 | 665 | 654 |
| 2 | B | 15 | 813 | 1150 | 75 | 780 | 45 | 430 | 29 | 650 | 643 | 631 |
| 3 | C | 25 | 813 | 1120 | 75 | 800 | 45 | 380 | 28 | 650 | 607 | 589 |
| 4 | D | 20 | 813 | 1150 | 70 | 780 | 45 | 400 | 33 | 650 | 634 | 627 |
| 5 | E | 25 | 813 | 1150 | 70 | 800 | 40 | 400 | 26 | 650 | 606 | 596 |
| 6 | F | 15 | 610 | 1080 | 75 | 850 | 45 | 380 | 8 | 650 | 679 | 678 |
| 7 | G | 20 | 610 | 1080 | 80 | 770 | 45 | 400 | 11 | 650 | 667 | 666 |
| 8 | H | 20 | 610 | 1150 | 75 | 750 | 40 | 250 | 14 | 650 | 701 | 683 |
| 9 | I | 15 | 610 | 1080 | 75 | 800 | 45 | 400 | 5 | 650 | 713 | 697 |
| **10** | C | 25 | 813 | **1000** | 75 | 800 | 48 | 410 | 30 | 650 | 579 | 548 |
| **11** | C | 25 | 813 | 1150 | 75 | 800 | 40 | **240** | 33 | 650 | 599 | 597 |
| **12** | C | 25 | 813 | 1150 | 75 | 800 | 40 | 400 | 31 | **500** | 583 | 555 |
| **13** | C | 25 | 813 | 1150 | 75 | 800 | 40 | 420 | — | — | 562 | 558 |
| **14** | G | 20 | 610 | 1200 | 75 | 800 | 40 | 280 | — | — | 676 | 681 |
| **15** | H | 20 | 610 | 1200 | 75 | 750 | 40 | 260 | — | — | 586 | 605 |
| **16** | H | 20 | 813 | 1200 | 75 | 750 | 40 | 260 | 16 | **350** | 633 | 617 |
| **17** | **J** | 20 | 813 | 1200 | 75 | 800 | 40 | 410 | 32 | 650 | 586 | 583 |
| **18** | **K** | 20 | 813 | 1200 | 75 | 750 | 40 | 400 | 29 | 650 | 633 | 627 |
| **19** | **L** | 15 | 813 | 1140 | 75 | 820 | 40 | 360 | 30 | 650 | 647 | 641 |
| **20** | **M** | 20 | 813 | 1100 | 75 | 840 | 25 | 350 | 33 | 650 | 633 | 624 |
| **21** | **N** | 20 | 813 | 1080 | 75 | 840 | 30 | 450 | 30 | 650 | 597 | 553 |
| **22** | **Q** | 20 | 813 | 1100 | 70 | 780 | 35 | 460 | 32 | 650 | 588 | 547 |
| **23** | **P** | 15 | 610 | 1140 | 75 | 820 | 40 | 360 | 15 | 650 | 647 | 638 |
| **24** | **Q** | 20 | 610 | 1100 | 70 | 780 | 35 | 390 | 15 | 650 | 664 | 642 |

TABLE 2-continued

| No. | Tensile Strength [Steel Plate] (MPa) before Heat Treatment | Tensile Strength [Steel Plate] (MPa) after Heat Treatment | Yield Strength [Steel Pipe] (MPa) before Heat Treatment | Yield Strength [Steel Pipe] (MPa) after Heat Treatment | Tensile Strength [Steel Pipe] (MPa) before Heat Treatment | Tensile Strength [Steel Pipe] (MPa) after Heat Treatment | $(TS_0 - TS)/TS_0$ [Steel Pipe Property] | $vE_{-20}$ (J) | Bainite Phase Fraction (%) | Note |
|---|---|---|---|---|---|---|---|---|---|---|
| 1 | 725 | 701 | 669 | 652 | 726 | 723 | 0.004 | 148 | 95 | Example Steel |
| 2 | 763 | 721 | 658 | 658 | 757 | 724 | 0.044 | 128 | 95 | Example Steel |
| 3 | 656 | 643 | 621 | 614 | 661 | 649 | 0.018 | 163 | 95 | Example Steel |
| 4 | 672 | 642 | 638 | 615 | 671 | 652 | 0.028 | 147 | 95 | Example Steel |
| 5 | 663 | 647 | 636 | 627 | 678 | 646 | 0.048 | 152 | 95 | Example Steel |
| 6 | 826 | 803 | 764 | 741 | 831 | 816 | 0.018 | 134 | 95 | Example Steel |
| 7 | 824 | 795 | 733 | 740 | 820 | 801 | 0.023 | 120 | 95 | Example Steel |
| 8 | 802 | 772 | 731 | 706 | 812 | 775 | 0.046 | 118 | 90 | Example Steel |
| 9 | 808 | 784 | 735 | 732 | 805 | 786 | 0.024 | 105 | 95 | Example Steel |
| **10** | 625 | 573 | 604 | 555 | 632 | 547 | **0.135** | 155 | 95 | Comparative Steel |
| **11** | 683 | 618 | 623 | 564 | 697 | 644 | **0.076** | 149 | 90 | Comparative Steel |
| **12** | 668 | 615 | 614 | 573 | 683 | 624 | **0.086** | 113 | 85 | Comparative Steel |
| **13** | 677 | 609 | 588 | 554 | 676 | 601 | **0.110** | 169 | 90 | Comparative Steel |
| **14** | 844 | 768 | 727 | 733 | 849 | 775 | **0.087** | 153 | 85 | Comparative Steel |
| **15** | 830 | 745 | 695 | 641 | 842 | 753 | **0.106** | 169 | 80 | Comparative Steel |
| **16** | 841 | 762 | 723 | 708 | 861 | 766 | **0.110** | 165 | 85 | Comparative Steel |
| **17** | 659 | 631 | 601 | 587 | 662 | 642 | 0.031 | **24** | 95 | Comparative Steel |
| **18** | 710 | 695 | 655 | 644 | 721 | 690 | 0.043 | **76** | 95 | Comparative Steel |
| **19** | 711 | 698 | 684 | 679 | 708 | 684 | 0.034 | **81** | 95 | Comparative Steel |
| **20** | 675 | 660 | 643 | 639 | 680 | 662 | 0.026 | **63** | 90 | Comparative Steel |
| **21** | 662 | 617 | 625 | 548 | 678 | 612 | **0.097** | 106 | 90 | Comparative Steel |
| **22** | 658 | 607 | 607 | 573 | 655 | 596 | **0.090** | 137 | 85 | Comparative Steel |
| **23** | 804 | 753 | 786 | 704 | 818 | 750 | **0.083** | 112 | 90 | Comparative Steel |
| **24** | 782 | 715 | 693 | 658 | 776 | 723 | **0.068** | **75** | 95 | Comparative Steel |

Annotation: An underlined portion written in bold indicates a value out of the range according to the present invention.

On the other hand, in the case of the comparative steels (10 through 16), whose chemical compositions were within the range according to embodiments of the present invention while the steel-plate-manufacturing conditions were out of the range according to embodiments of the present invention, $(TS_0-TS)/TS_0$ was unsatisfactory. In addition, in the case of the comparative steels (17 through 24), whose chemical compositions were out of the range according to embodiments of the present invention, at least one of the toughness of a HAZ and $(TS_0-TS)/TS_0$ was unsatisfactory.

The invention claimed is:

1. A high-strength steel having a chemical composition containing, by mass %, C: 0.040% to 0.090%, Si: 0.05% to 0.30%, Mn: 1.50% to 2.50%, P: 0.020% or less, S: 0.002% or less, Mo: 0.20% to 0.60%, Nb: 0.020% to 0.070%, Ti: 0.020% or less, V: 0.080% or less, Al: 0.045% or less, N: 0.0100% or less, and the balance being Fe and inevitable impurities, wherein the high-strength steel:

has a parameter $P_{eff}$, as calculated by equation (1):

$$P_{eff}(\%)=(0.13Nb+0.24V-0.125Ti)/(C+0.86N) \quad (1),$$

is of 0.070% or more, wherein the symbols of the chemical elements in equation (1) respectively denote the contents (mass %) of the corresponding chemical elements, and wherein the symbol of a chemical element which is not included is assigned a value of 0;

satisfies the relationship $(TS_0-TS)/TS_0 \leq 0.050$, wherein TS is defined as tensile strength determined at a temperature of 350° C. after aging has been performed under the condition of a Larson-Miller Parameter (LMP) of 15700, and wherein $TS_0$ is defined as tensile strength determined at a temperature of 350° C. before the aging is performed, wherein the high-strength steel has a yield strength of 555 MPa or more and the tensile strengths of 620 MPa or more determined at a temperature of 350° C., both before and after aging has been performed under the condition of the LMP, and wherein the high-strength steel has a microstructure comprising a bainite phase fraction of 70% or more in terms of area fraction.

2. The high-strength steel according to claim 1, wherein a value of Ti/N is in the range of 2.0 to 4.0, and X, as calculated by equation (2):

$$X=0.35Cr+0.9Mo+12Nb+8V \quad (2),$$

is 0.70% or more, wherein the symbols of the chemical elements in equation (2) respectively denote the contents (mass %) of the corresponding chemical elements, and wherein the symbol of a chemical element which is not included is assigned a value of 0.

3. The high-strength steel according to claim 1, the chemical composition of the high-strength steel further contains, by mass %, one, two, or more of:

Cu: 0.50% or less, Ni: 0.50% or less, Cr: 0.50% or less, and Ca: 0.0005% to 0.0040%.

4. A steel pipe composed of the high-strength steel according to claim 1, wherein butt portions of a steel plate are welded to form a pipe shape and wherein a weld heat-affected zone formed during welding has a toughness represented by a $vE_{-20}$ of 100 J or more.

5. A method for manufacturing the high-strength steel according to claim 1, the method comprising:

a heating process wherein a steel raw material is heated to a temperature of 1050° C. to 1200° C.;

a hot rolling process wherein the steel raw material, which has been heated in the heating process, is hot-rolled under the conditions of an accumulated rolling reduction ratio in a temperature range of 900° C. or lower of 50% or more and a rolling finish temperature of 850° C. or lower;

an accelerated cooling process wherein the hot-rolled steel plate, which has been obtained in the hot rolling process, is subjected to accelerated cooling under the conditions of a cooling rate of 5° C./s or more and a cooling stop temperature of 250° C. to 550° C.; and a reheating process wherein the hot-rolled steel plate is reheated, immediately after the accelerated cooling has been finished, under the conditions of a heating rate of 0.5° C./s or more and an end-point temperature of 550° C. to 700° C.

6. A method for manufacturing a steel pipe, the method comprising:

a cold forming process wherein a steel plate composed of the high-strength steel according to claim 1 is subjected to cold forming so as to be formed into a pipe shape; and a welding process wherein butt portions of the steel plate, which has been formed into a pipe shape in the cold forming process, are welded.

7. The high-strength steel according to claim 2, the chemical composition of the high-strength steel further contains, by mass %, one, two, or more of:

Cu: 0.50% or less, Ni: 0.50% or less, Cr: 0.50% or less, and Ca: 0.0005% to 0.0040%.

8. A steel pipe composed of the high-strength steel according to claim 2, wherein butt portions of a steel plate are welded to form a pipe shape and wherein a weld heat-affected zone formed during welding has a toughness represented by a $vE_{-20}$ of 100 J or more.

9. A steel pipe composed of the high-strength steel according to claim 3, wherein butt portions of a steel plate are welded to form a pipe shape and wherein a weld heat-affected zone formed during welding has a toughness represented by a $vE_{-20}$ of 100 J or more.

10. A steel pipe composed of the high-strength steel according to claim 7, wherein butt portions of a steel plate are welded to form a pipe shape and wherein a weld heat-affected zone formed during welding has a toughness represented by a $VE_{-20}$ of 100 J or more.

11. A method for manufacturing the high-strength steel according to claim 2, the method comprising:

a heating process wherein a steel raw material is heated to a temperature of 1050° C. to 1200° C.;

a hot rolling process wherein the steel raw material, which has been heated in the heating process, is hot-rolled under the conditions of an accumulated rolling reduction ratio in a temperature range of 900° C. or lower of 50% or more and a rolling finish temperature of 850° C. or lower;

an accelerated cooling process wherein the hot-rolled steel plate, which has been obtained in the hot rolling process, is subjected to accelerated cooling under the conditions of a cooling rate of 5° C./s or more and a cooling stop temperature of 250° C. to 550° C.; and a reheating process wherein the hot-rolled steel plate is reheated, immediately after the accelerated cooling has been finished, under the conditions of a heating rate of 0.5° C./s or more and an end-point temperature of 550° C. to 700° C.

12. A method for manufacturing the high-strength steel according to claim 3, the method comprising:

a heating process wherein a steel raw material is heated to a temperature of 1050° C. to 1200° C.;

a hot rolling process wherein the steel raw material, which has been heated in the heating process, is hot-rolled under the conditions of an accumulated rolling reduction ratio in a temperature range of 900° C. or lower of 50% or more and a rolling finish temperature of 850° C. or lower;

an accelerated cooling process wherein the hot-rolled steel plate, which has been obtained in the hot rolling process, is subjected to accelerated cooling under the conditions of a cooling rate of 5° C./s or more and a cooling stop temperature of 250° C. to 550° C.; and a reheating process wherein the hot-rolled steel plate is reheated, immediately after the accelerated cooling has been finished, under the conditions of a heating rate of 0.5° C./s or more and an end-point temperature of 550° C. to 700° C.

13. A method for manufacturing the high-strength steel according to claim 7, the method comprising:

a heating process wherein a steel raw material is heated to a temperature of 1050° C. to 1200° C.;

a hot rolling process wherein the steel raw material, which has been heated in the heating process, is hot-rolled under the conditions of an accumulated rolling reduction ratio in a temperature range of 900° C. or lower of 50% or more and a rolling finish temperature of 850° C. or lower;

an accelerated cooling process wherein the hot-rolled steel plate, which has been obtained in the hot rolling process, is subjected to accelerated cooling under the conditions of a cooling rate of 5° C./s or more and a cooling stop temperature of 250° C. to 550° C.; and a reheating process wherein the hot-rolled steel plate is reheated, immediately after the accelerated cooling has been finished, under the conditions of a heating rate of 0.5° C./s or more and an end-point temperature of 550° C. to 700° C.

14. A method for manufacturing a steel pipe, the method comprising:

a cold forming process wherein a steel plate composed of the high-strength steel according to claim 2 is subjected to cold forming so as to be formed into a pipe shape; and a welding process wherein butt portions of the steel plate, which has been formed into a pipe shape in the cold forming process, are welded.

15. A method for manufacturing a steel pipe, the method comprising:

a cold forming process wherein a steel plate composed of the high-strength steel according to claim 3 is subjected to cold forming so as to be formed into a pipe shape; and a welding process wherein butt portions of the steel plate, which has been formed into a pipe shape in the cold forming process, are welded.

16. A method for manufacturing a steel pipe, the method comprising:

a cold forming process wherein a steel plate composed of the high-strength steel according to claim 7 is subjected to cold forming so as to be formed into a pipe shape; and a welding process wherein butt portions of the steel plate, which has been formed into a pipe shape in the cold forming process, are welded.

* * * * *